US007371194B2

(12) United States Patent
Babiak et al.

(10) Patent No.: US 7,371,194 B2
(45) Date of Patent: May 13, 2008

(54) PORTABLE PLAYING FIELD FOR PLAYING A PLASTIC BALL AND BAT GAME

(76) Inventors: Robert Babiak, 904 Creamery Ct., Freehold, NJ (US) 07728; Lawrence A. Wiltbank, 483 East Rd., Belford, NJ (US) 07718

( * ) Notice: Subject to any disclaimer, the term of this patent is extended or adjusted under 35 U.S.C. 154(b) by 0 days.

(21) Appl. No.: 10/678,001

(22) Filed: Oct. 3, 2003

(65) Prior Publication Data

US 2005/0075199 A1 Apr. 7, 2005

(51) Int. Cl.
*A63B 67/00* (2006.01)

(52) U.S. Cl. ..... 473/468

(58) Field of Classification Search ..... 473/468, 473/454, 420, 422, 456, 478; 273/317.6
See application file for complete search history.

(56) References Cited

U.S. PATENT DOCUMENTS 2,964,321 A * 12/1960 Anderson ..... 473/478
3,668,781 A * 6/1972 Teter ..... 33/1 H
3,830,497 A * 8/1974 Peterson ..... 473/468
3,929,334 A * 12/1975 Magazzu ..... 473/478
5,562,289 A * 10/1996 McAllister ..... 473/468
6,179,734 B1 * 1/2001 Bravard ..... 473/499
6,620,065 B2 * 9/2003 Clabough ..... 473/454

* cited by examiner

*Primary Examiner*—Eugene Kim
*Assistant Examiner*—M. Chambers
(74) *Attorney, Agent, or Firm*—Mandel & Peslak, LLC; Arthur M. Peslak, Esq.

(57) ABSTRACT

This invention is a portable playing field for a plastic ball and bat game that can be easily set up in the backyard, park or beach, be used indoors or outdoors and professionally or a non-competitive environment. Hit markers automatically determine singles, doubles, triples and homeruns. The strike zone automatically determines if the pitch is a strike or ball. No bases are used so the game can be played with as few as 1 or 2-10 players. The field is adjustable to accommodate playing area or player use needs. A miniature size can also be used as a "table top" game that includes release buttons to pitch the ball and for the player to swing the bat.

1 Claim, 6 Drawing Sheets

Figure 3-A
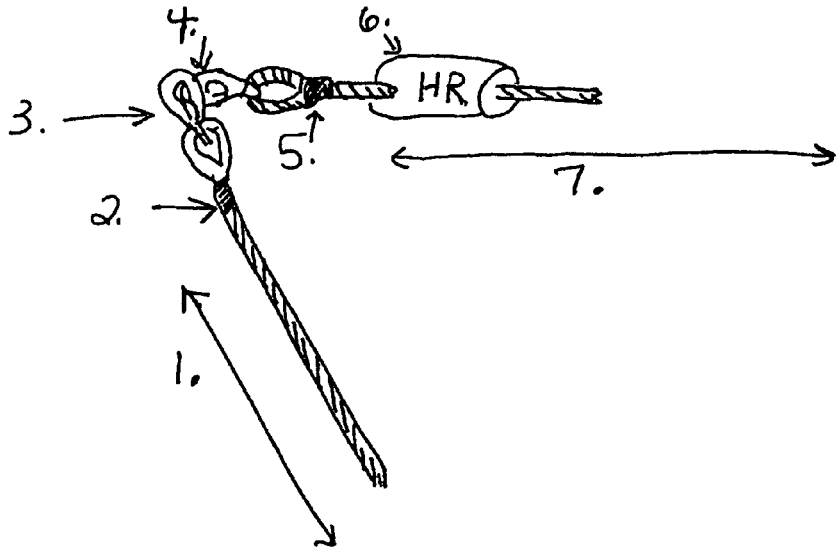
Figure 3-B
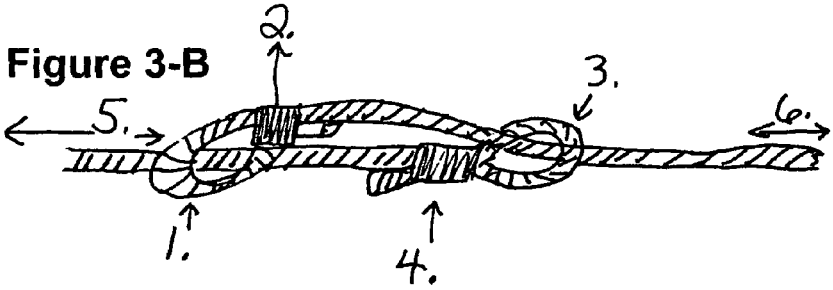

Figure 5-A
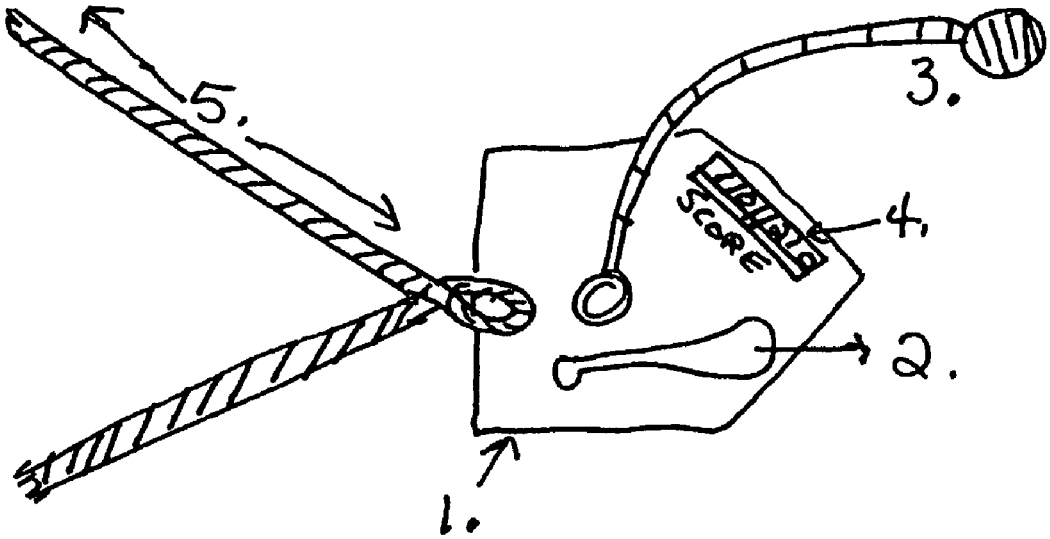
Figure 5-B
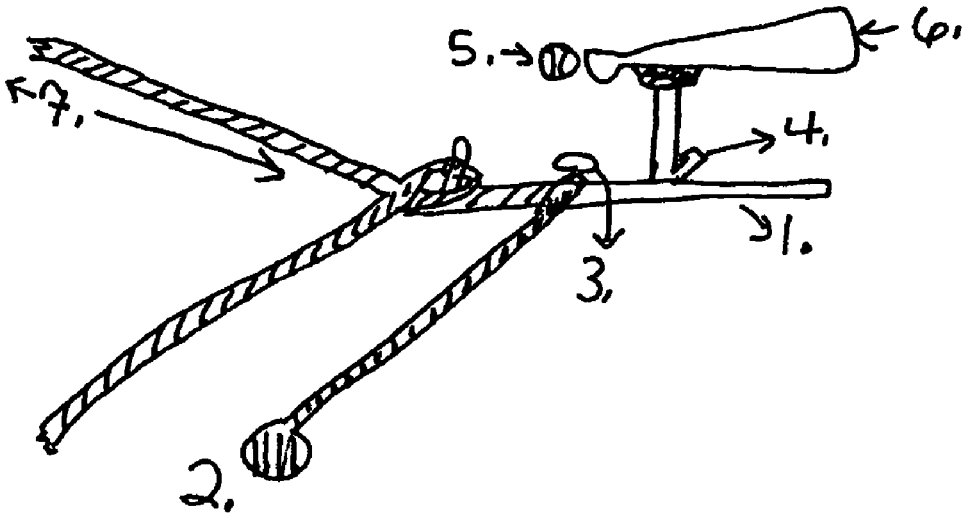

PORTABLE PLAYING FIELD FOR PLAYING A PLASTIC BALL AND BAT GAME

HomeField™: A portable playing field that can be easily set up in the backyard or park or beach, be used indoors or outdoors and professionally or a non-competitive environment. This product consists of ropes, hit markers (that designate how far the ball was hit—i.e. single, double, triple, home run), clasps to make length and width adjustable, ground stakes or indoor platform to secure ropes, home plate maker for the batter to stand, and a strike zone that determines if the pitch was a strike or a ball. No bases are used so the game can be played with a few as 1 or 2-10 players. Game is to be played with a plastic bat and ball. This playing field is adjustable to fit the area of the playing field (i.e., make smaller if indoors).

The whole field/game is stored in a bag that doubles for the strike zone. All parts of this product, including storage, is used to play the game.

It can also be made for table play in the form of HomeField Jr.™. This miniature size plastic ball and bat game can be played on a table, the grass or anywhere. The concept and design is such that a pump mechanism releases the ball into the air and a mini bat or player holding a bat swings the bat from a release button. The playing field is either a miniature roll-out field as described in the first paragraph or for hard surface play, an adjustable roll-out field with strike zone or a pre-set plastic mat. Hit markers on the field determine singles, doubles, triples and home runs. No bases are used. One or more players; scoreboard to keep store.

TITLE OF INVENTION

A portable playing field for playing a plastic ball and bat game that can be adjusted to accommodate the playing field size, indoor/outdoor use, skill levels, age groups, including professional use. The field automatically determines the hit (i.e. double or home run) and the pitch (i.e. strike). The field is easily portable and stored in a bag, that doubles as the strike zone.

A miniature version is used as a game that includes a hitting plate and figurine bat/batter. A manual button releases the pitch and another button swings the bat to hit the pitch. The scoreboard dial keeps track of runs.

CROSS REFERENCE TO RELATED APPLICATIONS

Provisional Patent Application Nos. 60/408,985 and 60/458,265.

STATEMENT REGARDING FEDERALLY SPONSORED RESEARCH OR DEVELOPMENT

Not Applicable

REFERENCE TO SEQUENCE LISTING

Not Applicable

BACKGROUND OF THE INVENTION

Currently, plastic ball and bat games are played in fields or floors by using tape to map out the playing field area. Each time the game is played the playing field needs to be measured and taped, and then the tape must be removed afterwards. This is particularly a problem on indoor floors or gym floors on which the tape leaves a sticky residue when removed. The professional plastic ball and bat games also use tape to mark the field. It is critical that the professional fields be measured accurately. This product eliminates the problem of potential mis-measurement.

Since plastic ball and bat games do not have base running as baseball does, this product offers a novel solution that is all inclusive in one bag to make playing the game fair, consistent, easy to use and easy to play anywhere. This product can be used professionally in professional competitions, during school gym classes, in the park, in one's basement or almost anywhere. The product is light weight and easy to set up and take down.

Another problem that exists with the way the game is played today is it is subjective as to whether or not the unhit pitch was a strike or a ball. The strike zone of this field objectively shows if a pitch is a strike or not (i.e. if the ball falls into the strike zone net, it is a strike).

The miniature playing/table game has the same concept, with the addition of a pump mechanism that releases the ball into the air and a mini bat or player holding a bat that swings the bat from a release button. The field is the same for the above described plastic ball and bat game but includes small bean bags to secure the field on a table. A Homefield™ Mat is also available that has the same field printed on a mat that can be easily rolled out and ready to play with the batter and pump mechanism to release the ball. A scoreboard is available with dials to keep track of runs.

BRIEF SUMMARY OF THE INVENTION

The product is a result of there being no such products available to make playing the plastic ball and bat game easy to play anywhere. For professional use, this product eliminates potential field measuring error, since it is manually done before each competition. Currently, plastic ball and bat games are played in fields or on floors by using tape to map out the playing field area. Each time the game is played the playing field needs to be measured and taped, and then the tape must be removed afterwards.

Since plastic ball and bat games do not have base running as baseball does, this product offers a novel solution that is all inclusive in one bag to make playing the game fair, consistent, easy to use and easy to play anywhere.

The invention is a portable playing field that can be easily set up in the backyard, park or beach, be used indoors or outdoors and professionally or a non-competitive environment.

The product consists of ropes, hit markers (that designate how far the ball was hit—i.e. single, double, triple, home run), clasps to make length and width adjustable, ground stakes or indoor platform to secure ropes, home plate marker for the batter to stand, and a strike zone that determines if the pitch was a strike or a ball. No bases are used so the game can be played with as few as 1 or 2-10 players. The game is to be played with a plastic bat and ball. This game can be resized by the user to fit the area of the playing field (i.e. make smaller if indoors).

The whole field/game is stored in a bag that doubles for the strike zone. All parts of this product, including storage, are used to play the game.

It can also be made for table play in the form of HomeField Jr.™. This miniature size plastic ball and bat game can be played on a table, the grass or anywhere. The concept and design is such that a pump mechanism releases the ball into the air and a mini bat or player holding a bat swings the bat from a release button. The playing field is either a miniature roll out field as described in the first paragraph or for hard surface play, an adjustable roll-out field with strike zone or a pre-set plastic mat. Hit markers on the field determine singles, doubles, triples and home runs. No bases are used. One or more players; scoreboard to keep score.

BRIEF DESCRIPTION OF THE DRAWINGS

1. Strike Zone
2. Mesh bag that carries the whole field ad when being used is pulled over the Strike Zone to catch the pitch
3. Strike zone ground post.
4. Clasp to place strike zone ground post
5. (HP) Home Plate Marker
6. Foul line to left (adjusts to 60')
7. Foul line to right (adjusts to 60')
8. Home Run Line (adjusts from 20' to 40')
9. Clasp on left to place ground stake to hold corner firm into ground
10. Ground stake
11. Clasp on right to place ground stake to hold corner firm into ground
12. Another ground stake
13. Side loops to allow for sizing of field
14. Hit Marker 1 for singles (can slide for field sizing)
15. Hit Marker 2 for doubles (can also slide for field sizing)
16. Hit Marker 3 for triples (can also slide for field sizing)
17. Hit Marker for home runs

1. Foul lines
2. Home Plate Markers (pulled to shorten sides of field)
3. Metal Rope Clamps
4. End Loop to Place Strike Zone and Frame
5. Direction of Strike Zone Frame FIG. 3: Close up of Foul Line and Home Run Line Connection; Close up Home Run Line Slide loops and Directions to Adjust Size.

FIG. 3-A: Foul Line Home Run Line Connection

1. Foul Line
2. Metal Rope Clamp
3. Clasp where ground stake would be placed
4. Clasp connecting Home Run Line to corner clasp
5. Metal Rope Clamp
6. HR—Home Run Marker
7. Home Run Line FIG. 3-B: Home Run Line Slide Loops

Figure 1:
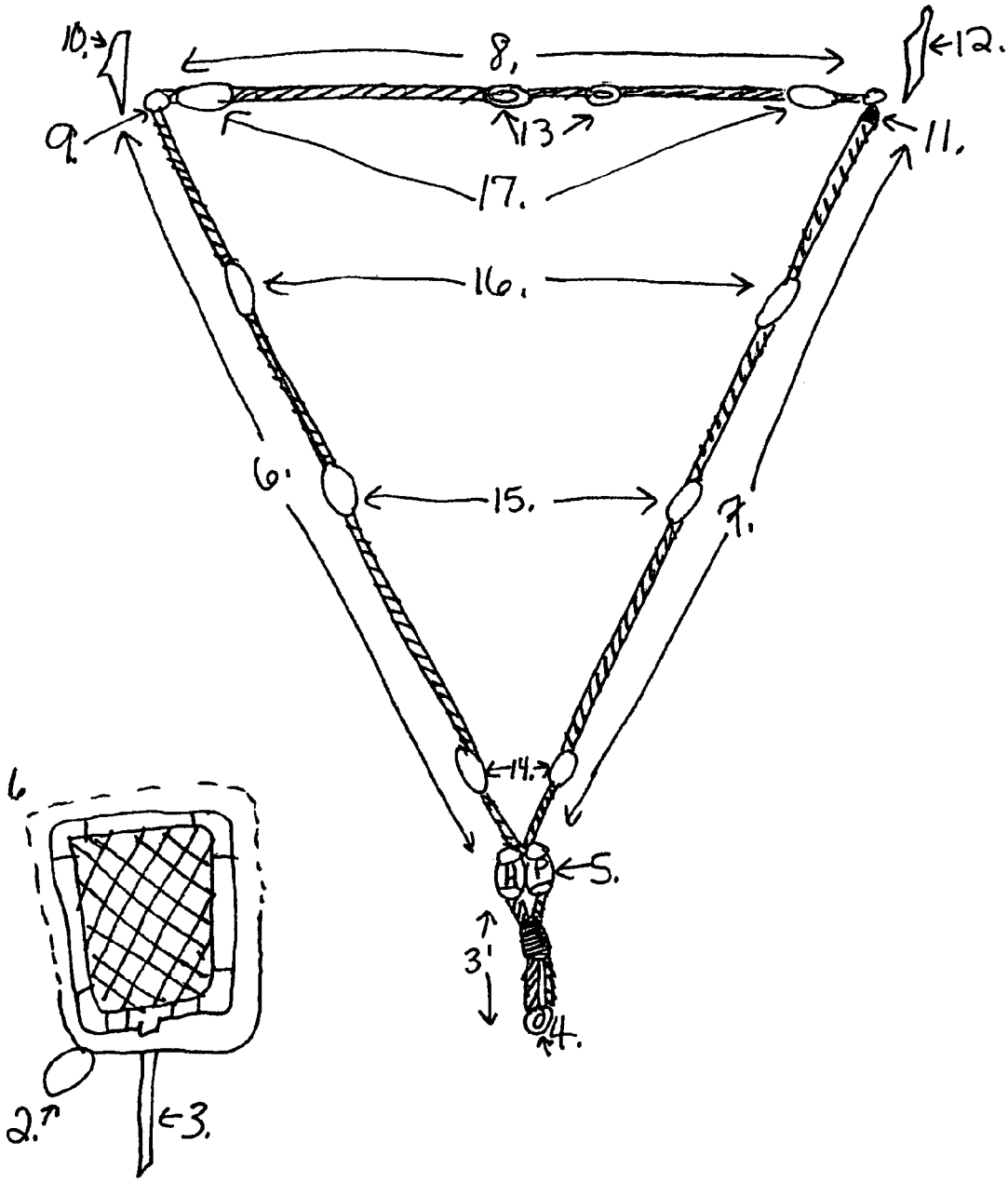
FIG. 1: Diagram of the playing field with strike zone.
Figure 2:
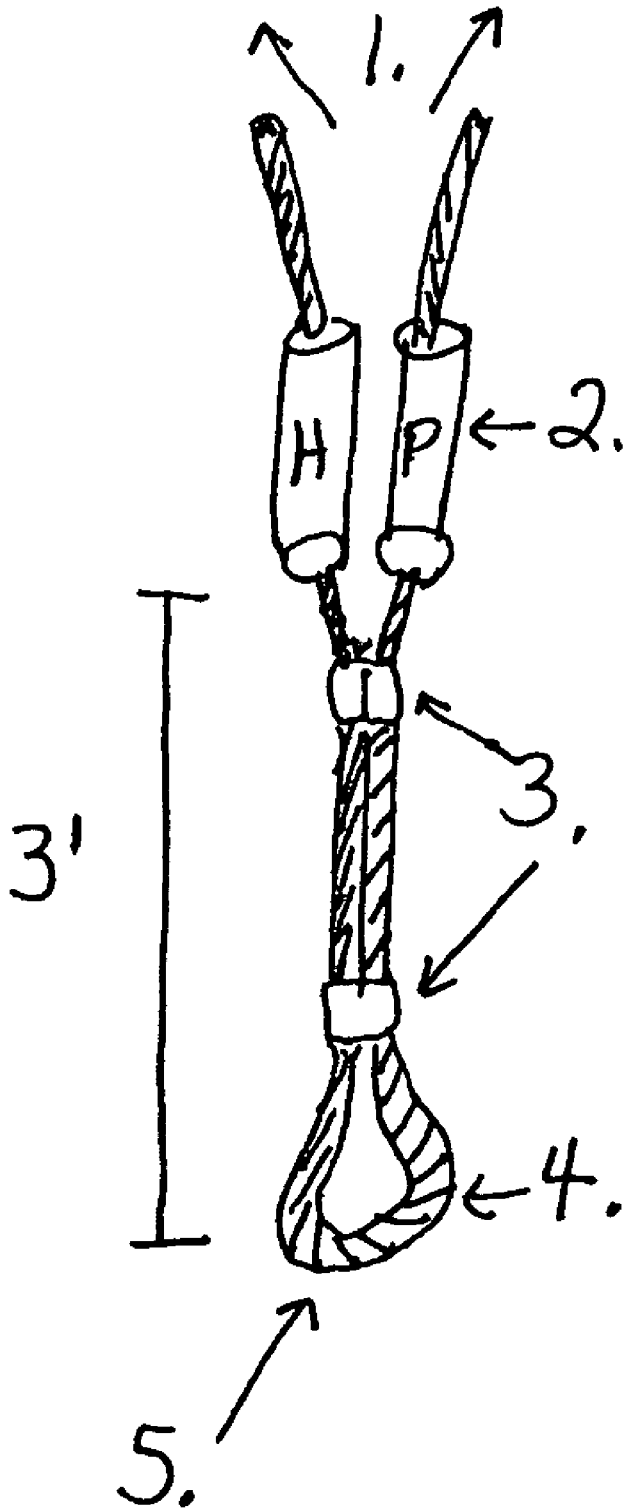
FIG. 2: Close up of Home Plate Marker and Foul Line End Loop and Directions to Shorten Foul Lines or length of Field.
Figure 4:
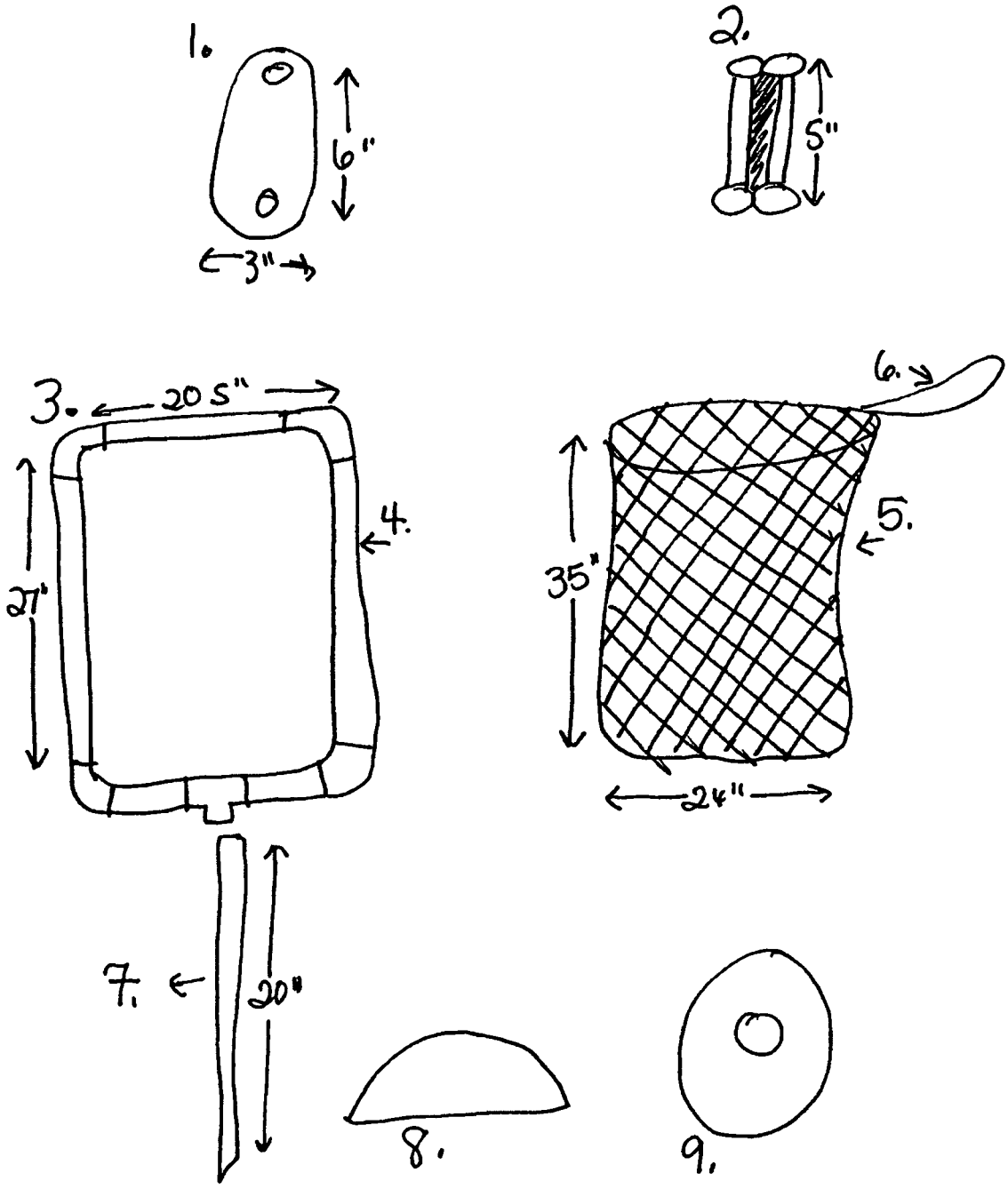

1. Loop
2. Metal Rope Clamp
3. Loop (Slides to Lengthen or Shorten Home Run Line)
4. Home Run Line
5. Home Run Line FIG. 4: Close Up of Hit Markers, Home Plate Marker, Strike Zone and Carrying Bag/Strike Zone Net and Indoor Platform

1. Hit Marker
2. Hope Plate Market
3. Strike Zone
4. Frame for Strike Zone
5. Carrying Bag that Doubles as the Strike Zone Net when Placed Over the Strike Zone
6. Drawstring to Tighten Bag Closed
7. Ground Post for Strike Zone
8. Indoor Platform Side View to Place Ground Post and Ground Stakes
9. Indoor Platform Top View to Place Ground Post and Ground Stakes FIG. 5: Miniature Playing Game Hitting Plate FIG. 5-A: Hitting Plate Top View

1. Hitting Plate Top View
2. Bat
3. Pump to Pump Ball Into Air
4. Scoreboard
5. Foul Line FIG. 5-B: Hitting Plate Side View

Figure 6:
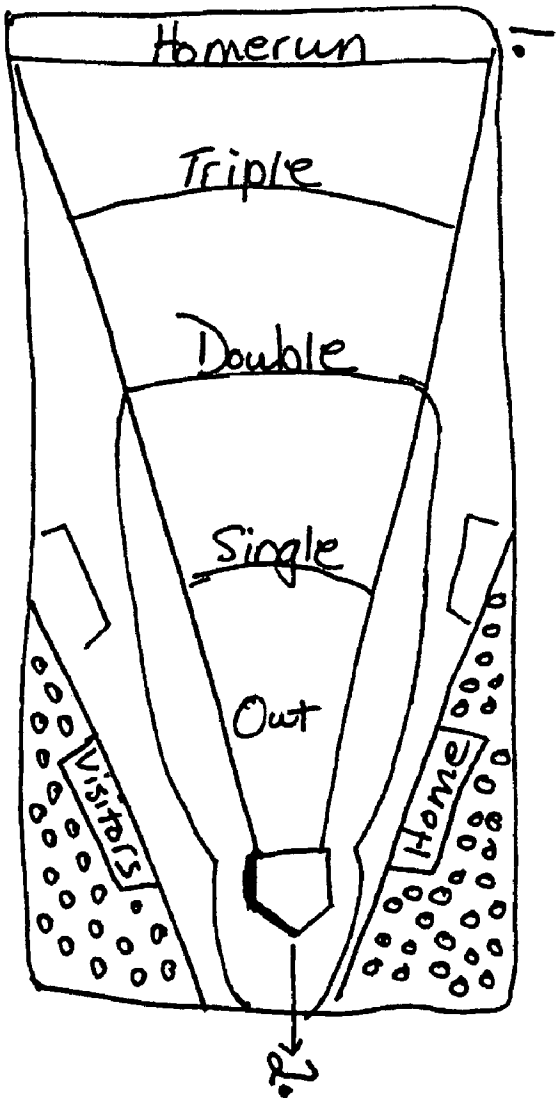

1. Hitting Plate Side View
2. Pump
3. Tee to Place Ball
4. Release Button for Bat (may have player figurine to swing bat)
5. Ball
6. Bat
7. Foul Line FIG. 6: HomeField™ Mat

1. HomeField™ Mat
2. Place Where Hitting Plate From Page 5 Would Be Placed

DETAILED DESCRIPTION OF THE INVENTION

1. Equipment

This product consists of a rope 6, 7, 8 that can be manually adjusted by pulling ends or corners of the ropes through clamps 4, 9, 11 that allow one to size the field accordingly. It has the game's traditional foul lines, single, double, triple and home run lines or hit markers. It also includes a home plate marker 5 for the batter to stand and a strike zone that definitively confirms if the un-hit pitch is a strike or a ball.

A. Field Lines 6, 7, 8: Made from ⅜-inch yellow nylon rope.

i. Foul Lines are each 60 feet long and are connected together at the home plate area 5 by a clamp 4. The doubled rope continues for an additional three feet with a second clamp six inches from the end to form to form a loop in which to place the strike zone ground post 3. The other end of each of the foul lines is clamped with a clasp 9, 11 at the end so the Home Run Line 8 can be detached. The foul line distance can be adjusted to a max of 60 feet. To shorten the distance pull back the foul line ropes 6, 7 where they meet through Home Plate markers and towards the strike zone.

ii. Home Run Line 8: Two 20-foot sections of rope are connected to each other with a slide knot so the width of the field can be adjusted from 20 to 40 feet. The Home Run Line 8 is connected to the Foul Lines 6, 7 by a clasp 9 so it may be disconnected to play without it or to move back to make a longer Home Run line 8.

B. Hit Markers 14, 15, 16, 17: Eight (8) are provided and are made from 5-inch long by 2¾-inch round soft plastic with a one-half inch hole through the center. Three markers will be placed on each of the foul lines to mark singles (1), doubles (2) and triples (3). One marker will be placed on each end of the Home Run Line to mark Home Runs (HR). Marker colors: Single (1)=Green; Double (2)=Red; Triple (3)=Orange; Home Run (HR)=Yellow.

C. Home Plate Marker (5): Consists of two 5-inch long half-inch PVC tubes connected together to allow the foul lines to slide through so the field can be adjusted to the desired distance.

D. Strike Zone: Frame 1 and Bag 3:

i. Frame 1 (rectangular): One-half-inch PVC piping, 20.5 inches wide by 27 inches high with a removable 20 inch ground post and platform.

ii. Carrying Bag/Strike Zone 3—Orange mesh with draw string 24 inches wide by 35 inches long and doubles as a carrying bag for the HomeField™ and as a Strike Zone by sliding it over the PVC frame.

E. Ground States 10 or Indoor Platform: Ground Stakes 10 are used alone in grass/dirt: two, 9-inch long plastic ground stakes to secure the end of the foul lines near the home run line. For indoor or hard surface use, an indoor platform (FIG. 4, Item 8) is a weighted, solid platform with a hole in the middle to secure the ground stakes.

2. How To Set Up The Game

A. Unroll rope field line 6, 7, 8 from strike zone frame 1 starting from the outfield working toward the home plate area.

B. Place Strike Zone 1 ground post 3 through loop at end of rope where the foul lines 6, 7 meet and push into ground at desired location.

C. Connect rectangular Strike Zone Frame 1 to ground post 3 and slide orange mesh bag 5 overtop, tighten drawstring and the Strike Zone is now complete.

D. Extend the two foul line 6, 7 to desired distance and width and secure by placing ground stakes through clasp at end of foul lines near Home Run Line 9.

E. Adjust Home Run Line 9 to proper width to fit the playing area by moving the slide loops.

F. Slide Home Plate marker 5 to Red=Minors or Green=Majors.

G. Slide the hit markers 14, 15, 16, 17 onto the foul lines where indicated on the ropes to meet your skill level.

| HIT | DISTANCE | |
|---|---|---|
| MARKER | MINORS (RED) | MAJORS (GREEN) |
| Green = Single (1) | 5 Feet | 5 Feet |
| Red = Double (2) | 20 Feet | 25 Feet |
| Orange = Triple (3) | 35 Feet | 45 Feet |
| Yellow = Home Run (HR | 50 Feet | 60 Feet |

Minors = Red Marks on rope;
Majors = Green marks on rope

H. These are only suggested distances. The hit markers 14, 15, 16, 17 may be placed at any distance you desire; that it why it is called HomeField™. You adjust the field t meet your skill level and playing area.

3. Playing Rules

A. Use any plastic bat and ball of your choice or according to regulations if professional use.

B. Game can be played with 1-10 players.

C. Use the hit markers 14, 15, 16, 17 and strike zone 1 to follow rules (i.e. a pitch in the bag is a strike or a high at the home run line is home run equivalent to a point).

D. Set the distance for the pitcher to throw from based upon age, skills and competitive rules.

4. Storing the Product.

A. Remove the two ground stakes from the ends of the foul lines 6, 7.

B. Remove orange mesh bag 5 and ground post 3 from the strike zone frame 1.

C. Wrap the rope around the rectangular strike zone frame until entire field is wrapped around.

D. Place frame, rope, ground post and two ground stakes in orange mesh bag and you are done.

For the Junior version of this paying game, field that will be used as a miniature game, the same set up applies, except for when the printed mat is used. (Note: Small bean bags are used to secure the field instead of ground stakes). When the printed mat is used, all the same rules apply but it eliminates the set up of ropes.

Playing the game: The Hitting Plate is placed within the field or on the mat. The button is pressed to release a pitch to the batter who swings upon pressing a button by the player. As few as one player can play or up to any amount one desires. A scoreboard has dials to keep track of runs.

What we claim in our invention is:

1. A portable kit for layout out a playing field that is adjustable in size to be used for playing a plastic ball and bat game comprising:

(a) a ground post;

(b) a plurality of ropes connected to the ground post and laid out on a playing surface for delineating foul lines of a 60-foot length for the game;

(c) A homerun rope connected to the ground post, laid out on the playing surface to delineate an adjustable, predetermined distance required for a ball to be hit during the game to be scored as a homerun wherein said plurality of ropes and said homerun rope forms a triangle when laid out on said playing surface;

(d) A plurality of markers slidingly attached to the plurality of ropes to adjustably delineate the distance required for a ball to be hit during the game to be scored as a single, a double or a triple;

(e) A home plate marker set onto the playing surface and connected to the ground post; (and)

(f) A strike zone connected to the ground post comprising a frame and a fabric attached to the frame whereby the frame comprises a second post attached to the ground post and a rectangle adapted to receive the fabric that delineates the strike zone wherein the fabric also comprises a carrying bag for all items comprising the portable playing field.

* * * * *